US005347936A

United States Patent [19]

Thorhuus

[11] Patent Number: 5,347,936

[45] Date of Patent: Sep. 20, 1994

[54] METHOD AND A DEVICE FOR PREHEATING A FLUIDIZED BED

[75] Inventor: Svante Thorhuus, Finspong, Sweden

[73] Assignee: ABB Stal AB, Finspong, Sweden

[21] Appl. No.: 838,308

[22] PCT Filed: Sep. 21, 1990

[86] PCT No.: PCT/SE90/00604

§ 371 Date: Mar. 11, 1992

§ 102(e) Date: Mar. 11, 1992

[87] PCT Pub. No.: WO91/04444

PCT Pub. Date: Apr. 4, 1991

[30] Foreign Application Priority Data

Sep. 22, 1989 [SE] Sweden ..... 8903123

[51] Int. Cl.[5] ..... F23C 1/02

[52] U.S. Cl. ..... 110/260; 110/185; 110/245; 110/347; 431/7; 431/170; 422/143

[58] Field of Search ..... 110/260, 245, 347, 263, 110/185; 122/4 D; 422/143; 431/7, 170; 165/104.16

[56] References Cited

U.S. PATENT DOCUMENTS 4,240,364 12/1980 Bryers et al. ..... 110/347
4,250,820 2/1981 Lautenschlager ..... 110/347
4,312,702 1/1982 Tomlinson, II ..... 122/7 C X
4,854,854 8/1989 Jonsson ..... 431/170

*Primary Examiner*—Edward G. Favors
*Attorney, Agent, or Firm*—Watson, Cole, Grindle & Watson

[57] ABSTRACT

A method and a device for preheating a particulate fluidized bed which is supplied with air for fluidization of bed material and for combustion of main fuel through gas paths that include fluidization members for injection and distribution of the air over the fluidized bed. The bed material is preheated to the ignition temperature for the main fuel used in the fluidized bed by members arranged in the gas paths for combustion of starting fuel. These members are designed and arranged so that the air is supplied to the fluidized bed along the same path through gas paths and fluidization members upon preheating with starting fuel as upon combustion of main fuel in the fluidized bed. The members for combustion of starting fuel are arranged in the fluidization members and comprise fuel injectors, fuel pipes, ignition members and control members. Around or upstream of the fuel injectors, flow-directing members are arranged to split up the air flow into a turbulent subflow adjacent to the fuel injectors and a main flow which is conducted past the members with minimum pressure loss.

10 Claims, 3 Drawing Sheets

METHOD AND A DEVICE FOR PREHEATING A FLUIDIZED BED

TECHNICAL FIELD

The invention relates to a fluidized bed with combustion of a main fuel supplied to the fluidized bed. In particular, the invention relates to a fluidized bed with combustion in a pressurized fluidized bed with particulate bed material, a so-called PFBC plant (Pressurized Fluidized Bed Combustion). More particularly, the invention relates to a method for preheating the bed material to at least the ignition temperature for the main fuel used in the fluidized bed, and to a device for carrying out this method.

BACKGROUND ART

Fluidized beds are well suited for combustion of solid, liquid as well as gaseous fuels. The air necessary for the combustion is also used for fluidization of the bed material. The great thermal inertia of the bed material causes the combustion to take place at low temperature, which suppresses the formation of undesired nitrogen oxides. The great heat capacity reduces disturbances caused by variations in the fuel. If sulphur-containing fuels are burnt, additions of sulphur absorbents such as lime, limestone or dolomite to the bed material may cause the emissions of sulphur oxides to be greatly reduced, because the sulphur, which is released during the combustion, is bound to the sulphur absorbent.

In order for the combustion to take place in a fluidized bed, however, the bed material must first be heated to the ignition temperature of the fuel. Heating can be performed by heat exchanger tubes provided in the fluidized bed, through which tubes superheated steam from an external source is injected. Special combustors may be inserted into the fluidized bed. Starting fuel, with a low ignition temperature, may be supplied to the fluidized bed, be ignited and during combustion preheat the fluidized bed. In case of large fluidized beds, however, the storage of the starting fuel/air mixture in the fluized bed entails a risk of explosion.

The bed material can be preheated outside the bed vessel and be supplied in hot state, or be recirculated through an external heating agent.

Normally, however, preheating is performed by injecting hot gases, preferably flue gases, through the bed. The flue gases are obtained during combustion in special start-up combustion chambers or start-up combustors, which may be integrated into the gas paths (according to VDI-Bericht Nr. 322, 1978, pp. 139–145), or be free-standing. To avoid corrosion, associated with flue gas condensate on the cold walls of the gas paths, the gas paths are normally preheated with hot, preferably dry air of a temperature which should amount to about 250° C., before combustion with fossil fuels is allowed in the gas paths.

Start-up combustors and start-up combustion chambers of a conventional design lead to heavy pressure drops and losses connected therewith across these combustors or combustion chambers if they are allowed to remain in the gas paths during operating conditions. To avoid this, the start-up combustors or start-up combustion chambers may either be introduced into or, by diverting the air flow to the fluidized bed, be connected to the gas paths only during start-up and be removed and disconnected from the gas paths when the plant is adjusted to operating condition.

SUMMARY OF THE INVENTION

With the method according to the invention and the means arranged in the gas paths for carrying out the method for combustion of a starting fuel, a fluidized bed may be heated to at least the ignition temperature for the main fuel used in the fluidized bed without having to introduce or connect special preheating equipment, as according to the prior art, during the start-up process. Nor does a bed preheater according to the invention cause losses due to pressure drops or other disturbance in the gas paths during operation. Therefore, the preheater can be arranged permanently in the gas paths, which is reflected in simplified design and reduced costs of construction.

According to the invention, the heating takes place by combustion of a starting fuel. The members for combustion of the starting fuel are integrated in the gas paths upstream of the fluidized bed, according to the invention. The gas paths are adapted to supply the fluidized bed with air for fluidization of the particulate bed material and for combustion of the main fuel supplied to the fluidized bed and comprise, inter alia, fluidization members arranged adjacent to the fluidized bed. Starting fuel is conducted to fuel injectors arranged in the fluidization members, is atomized by pressure in the fuel injectors by either supplying it through a pressure pipe or by supplying the fuel injectors simultaneously with a pressurized atomizing agent, for example steam or air. The atomized fuel is mixed with the air which flows through the fluidization members and is ignited. For ignition of the starting fuel/air mixture, ignition members are installed in the vicinity of the fuel injectors. Control members are also installed close to the fluidization members to determine whether ignition has taken place. After completed preheating, the fuel pipe is backflushed utilizing the overpressure in the fluidization members. A valve opens a shunt pipe so that the fuel pump and the fuel filter are bypassed. The fuel tank must not be subjected to overpressure.

By the ignition and control members utilized according to the invention, the accumulation of starting fuel in the gas paths and the associated risks of explosions are avoided.

According to the invention, the members for combustion of starting fuel are arranged and designed such that a minimum pressure drop arises across them while at the same time creating the necessary turbulence in the vicinity of the fuel injectors. This is achieved according to the invention by the arrangement of flow-directing members, preferably flanges or guide rails, around or upstream of the fuel injectors. The guide rails divide the air flow past the fuel injectors into a turbulent sub-flow which produces the pressure differences necessary for the combustion, and a main flow which is led past the fuel injectors with minimum disturbance.

BRIEF DESCRIPTION OF THE DRAWINGS

The principle of the invention is shown in FIG. 1. The integration of the invention in the fluidization members is shown in FIGS. 2 and 3.

DESCRIPTION OF THE PREFERRED EMBODIMENTS

Figure 1:
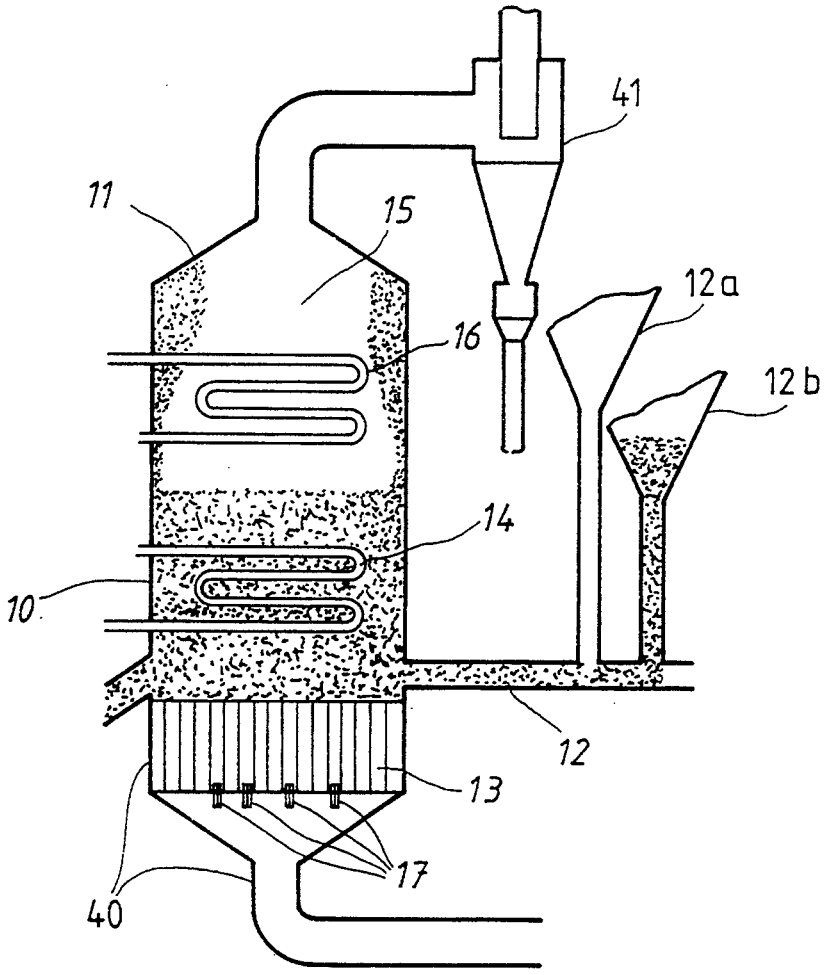
Figure 6:
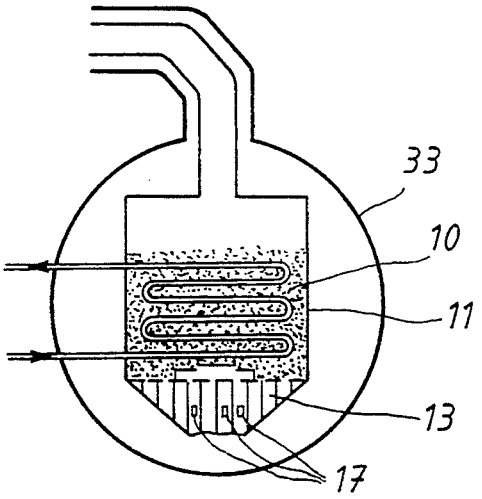

In a combustion plant with combustion in a particulate fluidized bed 10, according to FIG. 1 the fluidized bed 10 is adapted to be contained within a bed vessel 11. Bed material which, if the fuel is sulphurous, at least partially contains sulphur absorbents such as, for example, lime, limestone and dolomite, and fuel are arranged to be supplied through members 12. Air for fluidization and combustion of fuel supplied to the fluidized bed 10 is supplied through gas paths 40 provided in the combustion plant. Immediately upstream of the fluidized bed 10, fluidization members 13 are arranged in the gas paths 40 for injection and distribution of air over the fluidized bed 10.

In FIG. 1, 41 designates a conventional cyclone and 12*a* and 12*b* designate devices for the supply of sulphur absorbent and main fuel, respectively.

The main part of the heat released during the combustion is taken out through at least one heat transfer surface 14 arranged in the fluidized bed 10. Additional heat can be utilized in the freeboard 15 of the fluidized bed 10 by means of at least one heat transfer surface 16 arranged in the freeboard 15. Energy can also be extracted from the flue gases from the combustion in at least one gas turbine (not shown) arranged downstream of the fluidized bed 10 in the gas paths 40.

Before combustion of the supplied main fuel can start in the fluidized bed 10, the bed material must be heated to at least the ignition temperature of the main fuel, which in the case of combustion of coal means 400°–700° C. preferably 500°–600° C.

According to the invention, the mentioned preheating is accomplished by burning starting fuel in the gas paths 40 upstream of the fluidized bed 10 by means of members 17 adapted for combustion of starting fuel. As starting fuel, firing oil may be used but also other fuels with ignition temperatures lower than the main fuel used in the plant may be used. More specifically, the members 17 are arranged in the fluidization members 13. The members 17 are arranged and designed according to the invention so that they do not have to be removed from the gas paths 40 when switching from start-up to normal operation, i.e., combustion of the main fuel in the fluidized bed 10. Nor does any diversion of the air flow in the gas paths 40 take place, according to the invention, when changing from start-up to operation, i.e., the air is supplied to the fluidized bed 10 through the same gas paths 40 and fluidization members 13 upon preheating of the fluidized bed 10 with starting fuel as upon combustion of the main fuel in the fluidized bed.

Figure 2:
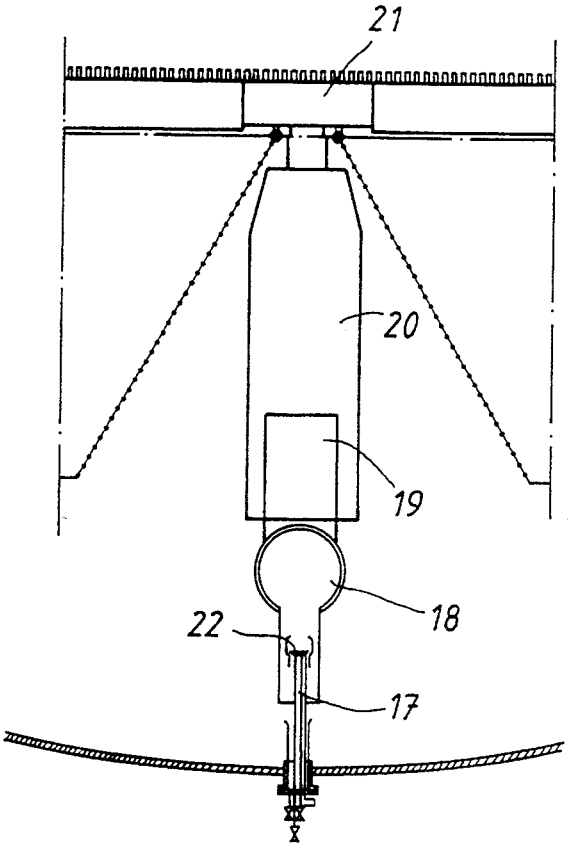
Figure 3:
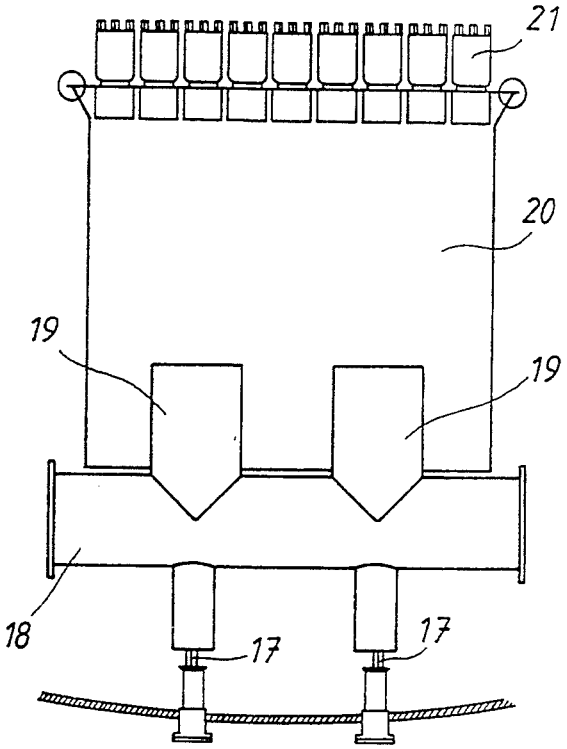
Figure 4:
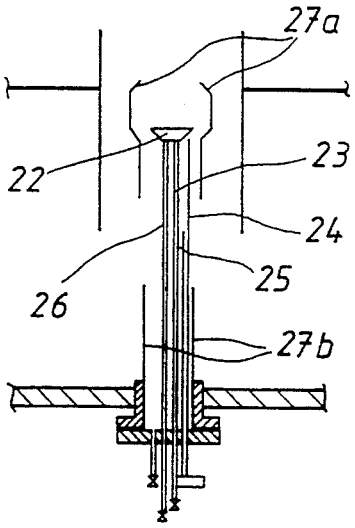
FIG. 4 shows the members for combustion of starting fuel comprising guide rails and fuel injectors. The circuits required for supply of starting fuel and the members used for ignition and supervision of the heating are shown in FIG. 5. The invention applied to a PFBC plant is illustrated in FIG. 6.

FIGS. 2, 3 and 4 show an application of the invention to a fluidized bed 10 where the fluidization members 13 comprise at least one inlet drum 18, at least one hot gas tube 19, at least one wind box 20 and at least one sparge tube 21. According to the invention, the members 17 for combustion of starting fuel are arranged in or adjacent the hot gas tubes 19. The members 17 are arranged so as to cause a minimum pressure loss in the gas paths 40, while at the same time a sufficient turbulence to generate conditions for stable combustion, is created around the members 17. The members 17 for combustion of starting fuel comprise at least one fuel injector 22, at least one fuel pipe 23, which may be pressurized, at least one ignition member 24 for ignition of the starting fuel, and at least one control member 25 for sensing whether the starting fuel has been ignited. To atomize the starting fuel in the fuel injectors 22, if the fuel pipe is not pressurized, the members 17 are supplemented by a pressure pipe 26 for a pressurized atomizing agent, for example steam or air. Examples of ignition members and control members will be given with reference to the description of FIG. 5.

The condition for leaving the members 17, according to the invention, in the gas paths 40 also during the normal operating state of the plant, i.e., combustion of the main fuel in the fluidized bed 10, is that the members 17 according to the invention are adapted to produce minimum pressure losses in the gas paths 40 while at the same time creating sufficient turbulence for stable combustion around the fuel injectors 22. The above-mentioned flow situation is achieved according to the invention by arranging flow-directing members 27*a*, 27*b*, preferably in the form of flanges or guide rails, around and/or upstream of the fuel injectors 22 so as to create a turbulent sub-flow around the fuel injectors 22 while at the same time the main flow is conducted past the members 17 with minimum disturbance, minimum pressure loss.

In order to avoid, during preheating, corrosive condensates on the walls of the gas paths 40 or on other components present in the gas paths 40, combustion of fossil fuels in the gas paths 40 normally does not take place until the the gas paths 40 of the plant have been preheated with dry hot air. This is the case also during heating according to the present invention.

Figure 5:
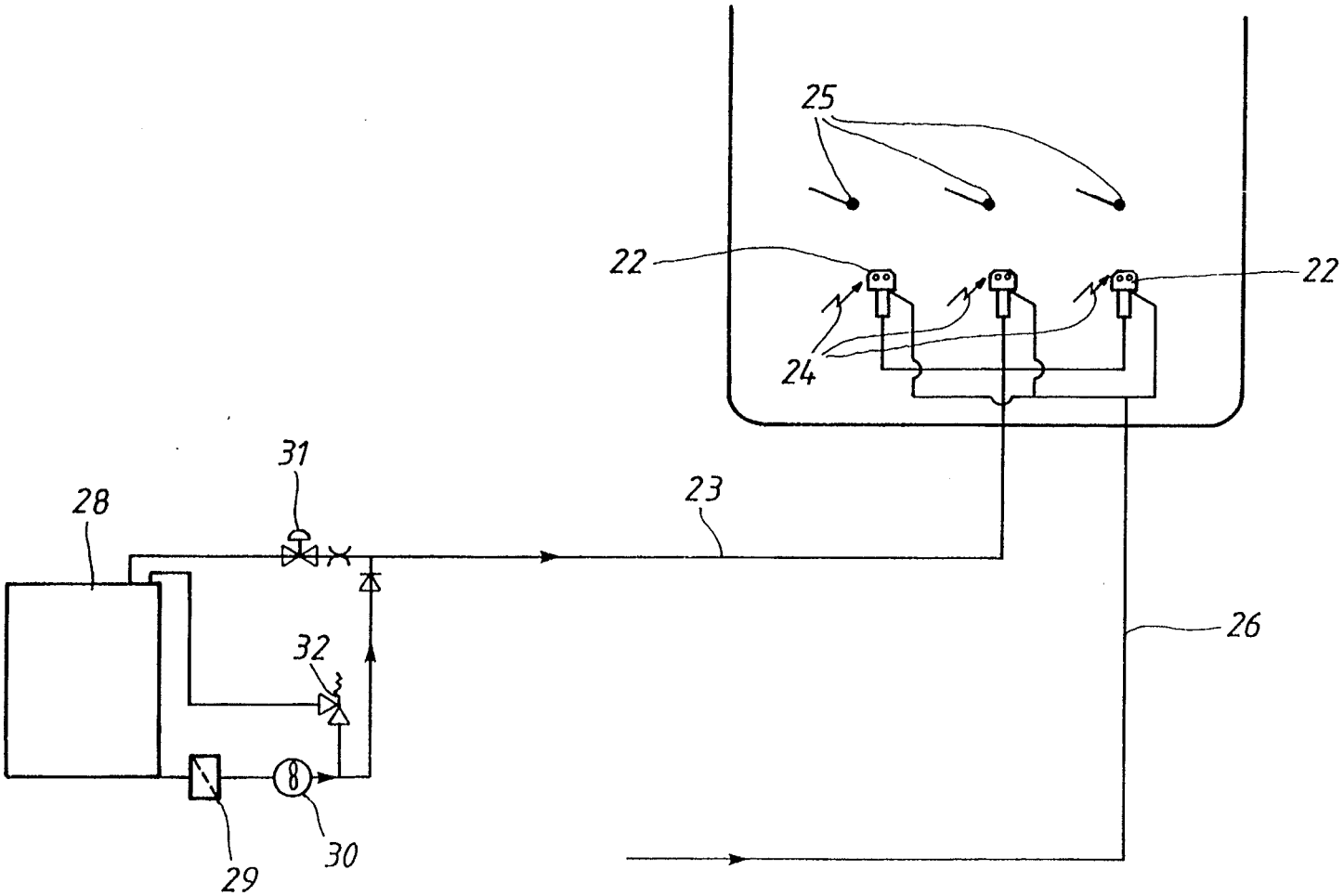

The fuel circuit necessary for the preheating according to the invention and the means necessary for ignition and for supervision of the preheating are shown schematically in FIG. 5. Fuel from a fuel tank 28 is transferred to the fuel injectors 22 through the fuel pipe 23. To remove undesired components, the fuel passes through a fuel filter 29. A fuel pump 30, for example, is utilized for the transfer. For ignition of the starting fuel, ignition members 24, such as a sparking plug, an incandescent filament or a pilot flame, are arranged close to the fuel injectors 22. To check that the starting fuel has ignited, control members 25, for example thermoelements or other thermo-sensors, or alternatively an optical flame detector of the photocell type, are arranged also adjacent to the fuel injectors 22. After completed preheating, the fuel pipe 23 is backflushed to the fuel tank 28 while utilizing the overpressure in the hot gas tubes 18. A valve 31 opens a shunt pipe so that the fuel pump 30 and the fuel filter 29 are not backflushed. A valve 32 ensures that the fuel tank 28 is not subjected to overpressure.

In a plant with combustion in a pressurized fluidized bed, a PFBC plant, the bed vessel 11 containing the fluidized bed 10 is enclosed in a pressure vessel 33. The pressure vessel 33 is supplied with air which has been pressurized in a compressor (not shown). The pressurized air is conducted from the pressure vessel 33 into the fluidized bed 10 through the fluidization members 13. As in the general case, the members 17 for combustion of starting fuel are arranged in the fluidization members 13.

I claim:

1. An apparatus for supplying air to a fluidized bed and for preheating the fluidized bed prior to the supply thereto of a main fuel, said apparatus comprising gas path means for supplying air to the fluidized bed for fluidization of said fluidized bed and for combustion of a main fuel supplied to the fluidized bed, a plurality of fluidization members in said gas path means for injection and distribution of said air over said fluidized bed, combustion members positioned adjacent said fluidization members for combustion of a starting fuel, said combustion members including fuel injectors, and flow-directing members for splitting up air flow passing said fuel injectors into a turbulent subflow adjacent said fuel injectors and a main flow which is conducted past said flow-directing members to enable combustion of said starting fuel with a minimum disturbance and minimum pressure drop.

2. An apparatus according to claim 1, wherein said fuel injectors atomize said starting fuel, and wherein said combustion members include fuel pipes connected to said fuel injectors for supplying starting fuel thereto, ignition members for igniting the starting fuel, and control members for sensing whether the starting fuel has ignited.

3. An apparatus according to claim 1, wherein said flow-directing means comprise flanges.

4. An apparatus according to claim 1, wherein said flow-directing means comprise guide vanes.

5. An apparatus according to claim 1, wherein said combustion members include supplemental pressure pipes for supplying atomizing steam or air to said fuel injectors.

6. A power plant which includes means for a fluidized bed and an apparatus for supplying air to the fluidized bed and for preheating the fluidized bed prior to the supply thereto of a main fuel, said bed preheater comprising gas path means for supplying air to the fluidized bed for fluidization of said fluidized bed and for combustion of a main fuel supplied to the fluidized bed, a plurality of fluidization members in said gas path means for injection and distribution of said air over to said fluidized bed, combustion members positioned adjacent said fluidization members for combustion of a starting fuel, said combustion members including fuel injectors, and flow-directing members for splitting up air flow passing said fuel injectors into a turbulent subflow adjacent said fuel injectors and a main flow which is conducted past said flow-directing members to enable combustion of said starting fuel with a minimum disturbance and minimum pressure drop.

7. A method of preheating a fluidized bed prior to the supply thereto of a main fuel, said fluidized bed being supplied with air through a plurality of fluidization members positioned in a gas path means, said air fluidizing said bed and enabling combustion of a main fuel supplied thereto, said method comprising the steps of:

(a) positioning fuel injectors adjacent said fluidization members, (b) positioning flow-directing members adjacent said combustion members to provide a turbulent subflow of air adjacent to the fuel injectors and a main air flow which is conducted past the fuel injectors with a minimum of disturbance, and (c) supplying a starting fuel to said fuel injectors to burn with the air in the subflows of air therearound to heat the subflows of air.

8. The method of claim 7, including the step of supplying pressurized atomizing fluid to said fuel injectors.

9. The method of claim 7, wherein the fluidized bed is preheated by said heated subflow of air to 500° to 600° C.

10. The method of claim 7, wherein the fluidized bed contain non-combustible material and sulfur absorbed material and said main fuel is coal.

* * * * *